United States Patent [19]

Sepling

[11] Patent Number: 4,774,987

[45] Date of Patent: Oct. 4, 1988

[54] APPARATUS FOR FEEDING ROUNDWOOD INTO A ROTATING BARKING DRUM

[75] Inventor: Matti Sepling, Rajamaki, Finland

[73] Assignee: Kone Oy, Hyvinkaa, Finland

[21] Appl. No.: 17,049

[22] Filed: Feb. 20, 1987

[30] Foreign Application Priority Data

Nov. 26, 1986 [FI] Finland ..... 864827

[51] Int. Cl.[4] ..... B27L 1/02

[52] U.S. Cl. ..... 144/208 B; 144/242 D; 144/341; 198/624; 198/836

[58] Field of Search ..... 198/620, 624, 836; 144/208 R, 208 B, 341, 242 D, 245 A

[56] References Cited

U.S. PATENT DOCUMENTS 4,596,280 6/1986 Svensson ..... 144/2 Z

*Primary Examiner*—W. Donald Bray

*Attorney, Agent, or Firm*—Sughrue, Mion, Zinn, Macpeak and Seas

[57] ABSTRACT

An apparatus for feeding roundwood into a rotating debarking drum through the inlet end of the barking drum utilizing a conveyor. The prior method presents the drawback that it is not possible, with a single feed device, to feed into the barking drum roundwood of different lengths but only either long, intermediate-sized or short logs. With the present invention, this problem has been solved in that the logs are positively fed by the conveyor, at low speed, into the lower part of the barking drum, through a feed cylinder.

9 Claims, 3 Drawing Sheets

APPARATUS FOR FEEDING ROUNDWOOD INTO A ROTATING BARKING DRUM

FIELD OF THE INVENTION

The present invention relates to apparatus for feeding roundwood into a rotating debarking drum through the inlet end of the barking drum.

BACKGROUND OF THE INVENTION

Wood processing installations producing chips in pulp and paper mills, or separate chipping mills, must be able to receive and handle large quantities of logs of different lengths, varying from short, (2 to 3-meter) to treelength (12 to 18 meters) roundwood.

It is important for roundwood processing plants that all wood can be transported to the plant, including treelength stems. This is so that they can be barked and chipped in the condition in which they are received, which means that several extra timber processing steps (e.g. cross-cutting, transporting from one conveyor to another, etc.) are obviated in the installation. In addition, the following advantages emerge: the chip quality improves when long wood is being chipped; and wood losses and the amount of short billets become less. At the same time, the investment, labor and maintenance costs of the entire roundwood processing plant are reduced.

Although the debarking and chipping of long wood is economically the most advantageous, and qualitatively the best processing method, more extensive use of this method has been restricted by the low capacity of the long timber feeding methods and apparatus previously used and known in the art. It has been further restricted by the intermittent mode of operation, as well as the fact that such methods are only applicable in the case of long wood.

Since a procedure has been lacking which would enable the feeding of both long wood and short wood into the debarking drum using one and the same feeding means, it has been necessary heretofore either to cut up long tree stems on a circular saw deck, e.g. into two or more pieces, prior to feeding them into the debarking drum; or two separate feed lines serving the drum have been constructed, one for long wood and another for short wood.

DESCRIPTION OF THE PRIOR ART

In the following, two prior art procedures are examined more closely. In the first procedure, the logs are fed through an inclined feed chute, making use of gravity. This kind of feed chute is used in debarking drums when the logs are relatively short. The feed chute must be steep enough so that the wood will slide downwards along the chute into the drum. Furthermore, the lower edge of the chute should be high enough over the bottom of the drum so that free entry of the roundwood into the drum is afforded. This type of feed chute does not work with long stems at all because long logs remain at rest in the chute and cannot flow down into the drum.

In feeding long wood, a feed chute is used which is steeper at its initial end and more gently inclined at its discharge end. The shape of the chute bottom is round, and its lower edge joins the drum near the drum's bottom. A drawback to this connection is that, as the feed chute becomes more gently inclined towards its end, the horizontal gravity component pushing the timbers forward also diminishes, and the logs consequently do not enter the drum. For making the matter easier, the wood is loaded into the chute with their butt ends first. Nevertheless, the result is that the sliding of the logs into the drum is slow and therefore the capacity is low. Also, the filling coefficient of the drum is low because long wood seeking entrance into the drum at an incline disturb those logs which have already settled parallel to the drum and which are undergoing parallel barking. This type of feed chute does not work with shorter logs because short logs remain lying on the gently inclined section of the chute, and as more wood is fed into the chute, jams occur.

For feeding roundwood of intermediate length (3 to 8 meters) into the debarking drum a different procedure has been employed in which the logs are "projected", that is, fed with high velocity, into the empty space which forms in the upper part of the debarking drum. The procedure is applicable for wood not longer than 6–8 m. The rapidly rotating spiked roller conveyor employed in this procedure may only carry a single log layer. The procedure is not usable when feeding treelength wood, because logs with a length of 12–18 m cannot be projected all the way into the drum. Therefore the leading end of the log falls down to the bottom of the drum and the trailing end remains on the roller conveyors. When this happens, a jam is created in the narrow conveyor and those logs which have already partly entered the drum will snap off, or the drum may suffer damage.

BRIEF SUMMARY OF THE INVENTION

It is an object of the present invention to provide novel and advantageous apparatus for feeding roundwood of different lengths into a barking drum.

The present invention provides apparatus for feeding roundwood into a rotating debarking drum by means of a conveyor located in front of a feeding end of the barking drum. This apparatus consists of a feed cylinder operating as a stationary extension to the debarking drum, the feed cylinder having a diameter equal to or slightly less than the free inner diameter of the debarking drum.

In an advantageous embodiment of the invention, the feeder conveyor is disposed at the bottom of the feed cylinder, and an additional means is provided on the side of the feed cylinder for transporting the logs towards the barking drum. Such a means would most advantageously be comprised of rotating spiked or helical rollers.

In another advantageous embodiment of the invention, the feed cylinder has a cross-section which is either round or curvilinearly tapered on one side. The bottoms of the feed cylinder and the debarking drum lie in a common horizontal plane at a point where they meet.

Since in the present invention the roundwood is positively fed, and the direction in which they are fed is the same as the longitudinal direction of the drum, the present apparatus is well suited for feeding both treelength logs as well as shorter logs into the barking drum using the same apparatus. With this apparatus, the filling coefficient and the discharging capacity of the debarking drum can also be regulated in a controlled manner so as to be consistent with the need of drum treatment (the dwelling time), which is determined by the barking characteristics of the wood. This is accomplished by increasing or reducing the rate at which logs are fed into the drum and/or by changing the cross-sectional area of the wood flow that is being fed.

The feed cylinder, serving as a front extension to the drum in itself, contributes, owing to its round shape, to allowing rotation of the "tail ends" of long stems, which project from the drum into the feed cylinder without causing binding or snapping off. It will thus be understood that barking of the roundwood begins in the feed cylinder, and therefore the feed cylinder also has the effect of increasing the barking capacity of the drum.

To facilitate faultless operation of the apparatus, the bottoms of the feed cylinder and the barking drum are preferably in the same horizontal plane at the point where they meet. If the bottom of the debarking drum were to lie at a lower level than that of the feed cylinder, the timbers would turn on entering the debarking drum so that they would fail to meet the "pushers" on the chain conveyor, and thus the desired positive feed would not be achieved.

BRIEF DESCRIPTION OF THE DRAWINGS

Further objects, features and advantages of the present invention are described in the following in greater detail with reference to the accompanying drawings, in which.

DESCRIPTION OF THE PREFERRED EMBODIMENTS

Figure 1:
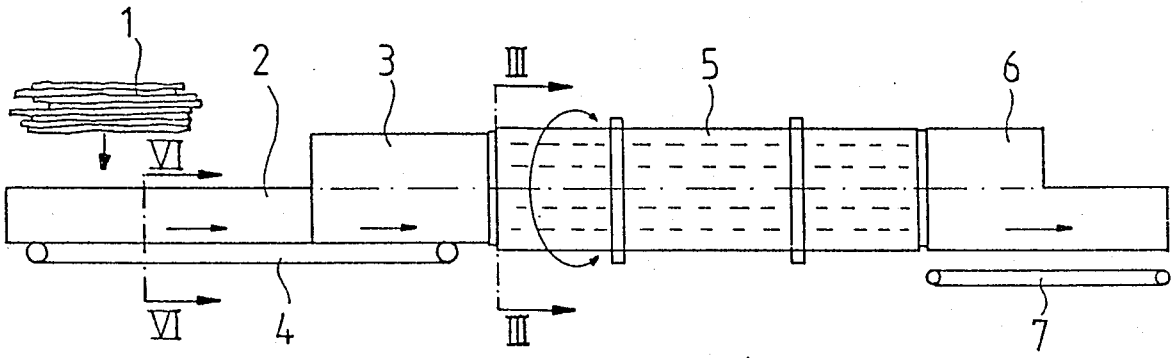
FIG. 1 shows a diagrammatic view in elevation of a roundwood debarking/chipping line provided with a feed apparatus according to the present invention.
Figure 3:
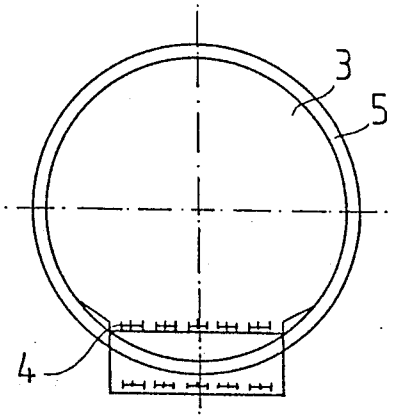
FIG. 3 shows a cross-section along the line III—III of FIG. 1.
Figure 6:
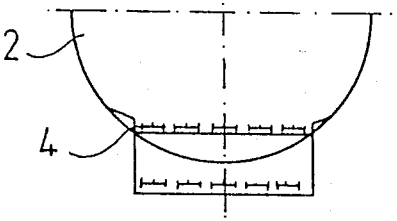
FIG. 6 shows a cross-section along the line VI—VI of FIG. 1.

In FIG. 1 there is illustrated a debarking and chipping line for long and short logs, showing the feed apparatus embodying the present invention. The feed apparatus consists of a stationary loading section 2 and a stationary feed cylinder 3. At the bottom of both has been installed a conveyor 4, which transports the logs positively at low speed (i.e. 1–6 meters/min.) by applying mechanical force. The conveyor 4 is most advantageously a chain feeder or the equivalent. The most advantageous cross-sectional shapes of the loading section 2 and the feed cylinder 3 are depicted in FIGS. 3–7. In FIG. 3, for example, the feed cylinder 3 is shown as having a round cross-section whereas the feed cylinder shown in FIG. 4 has a cross-section which is curvilinearly tapered at one side. As can be seen from FIG. 1, the feed cylinder 3 and the debarking drum 5 lie in a common horizontal plane at the point where they meet.

The debarking and chipping line operates as follows: a bundle of roundwood, comprised of logs of different lengths, is conveyed to the loading section 2, whereby the chain feeder 4 will carry the logs positively into the feeding cylinder 3 and thence into the rotating debarking drum 5. From the debarking drum, the barked wood proceeds with the aid of a discharge chute 6 and a conveyor 7 towards further processing.

The diameter of the stationary feed cylinder is the same as, or slightly less than the inner free diameter of the debarking drum 5. The feed cylinder may be either round or, as in FIG. 4, tapered at one side in a curvilinear fashion.

Figure 2:
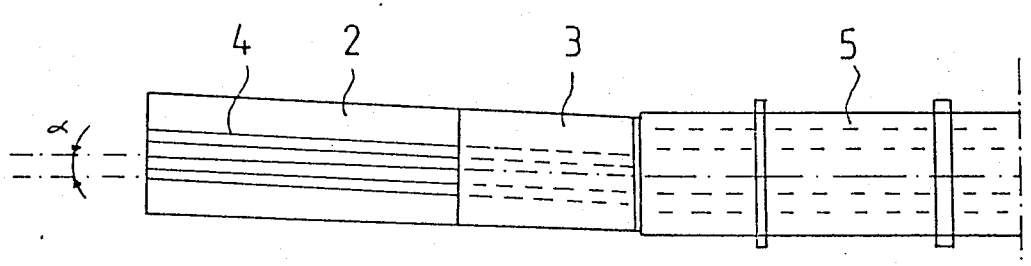
FIG. 2 shows a plan view of the feed apparatus and the debarking drum.
Figure 4:
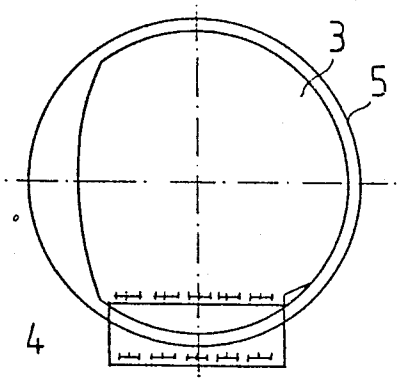
FIG. 4 shows a cross-section of another embodiment at a location corresponding to that of FIG. 3.
Figure 7:
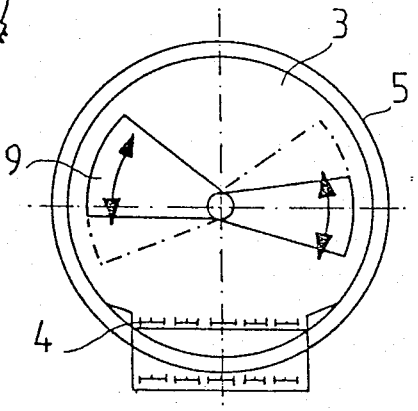
FIG. 7 shows a cross-section of a still further embodiment, again at a location corresponding to that of FIG. 3.

In order to orient long logs longitudinally with respect to the drum, at the stage when they are being fed into the rotating debarking drum, the feed apparatus may be swivelled in the horizontal plane through an angle, most advantageously 0°–8° (FIG. 2). It has been found, in tests that have been carried out, that it is most advantageous to effect this swivelling towards that side at which the rotating debarking drum is descending.

Figure 5:
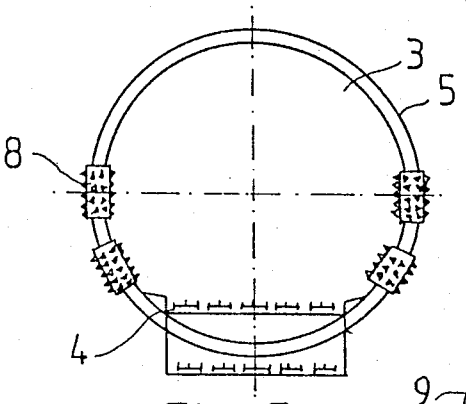
FIG. 5 shows a cross-section of yet another embodiment, taken at a location also corresponding to that of FIG. 3.

By mounting spiked rollers 8 on the sides of the feed cylinder 3, as shown in FIG. 5, the timber debarking effect taking place in the debarking drum can be enhanced. This is because the pulling spiked rollers 8 serve to incise and pretreat the bark layer on the timber and, on the other hand, to push the timbers into the debarking drum 5.

The feed cylinder 3 may also be used for thawing frozen wood by introducing heat energy (hot water or steam) into the feed cylinder. Since the debarking drum 5 causes partial rotation of the logs in the feed cylinder 3, the thawing medium (hot water or steam) will effectively reach frozen log surfaces and heat energy utilization is therefore more efficient than in prior art thawing apparatus.

It is understood that loading of the roundwood 1 is effected by depositing them into the trough-like loading section 2, which is provided as an extension of the feed cylinder 3. Since the feed apparatus is located at a relatively low height, mobile truck loading may be used, as well as conventional loading using a crane. The chain feeder which conveys the roundwood into the drum may be common to the loading section 2 and the feed cylinder 3. Or, if required, it may consist of separate feeders for the loading section and the feed cylinder (one for the loading section and one for the feed cylinder) in order to make the depth of the wood bundle lower. The wood flow being fed into the drum may also, if required, be regulated with a regulator gate 9 (FIG. 7) placed between the loading section 2 and the feed cylinder 3.

Figure 8:
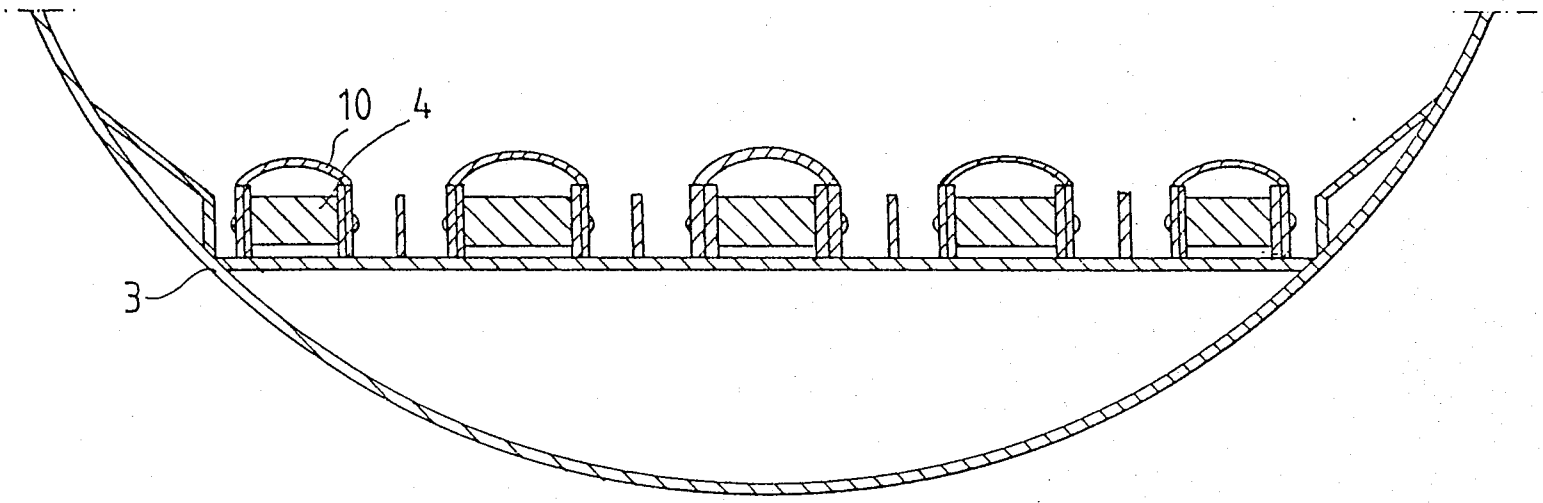
FIG. 8 shows an enlarged cross-section of a chain feeder trough.

In FIG. 8 there is depicted, on a larger scale, the design of the chain feeder serving as the conveyor 4. In the present instance, the chain feeder consists of five parallel endless chains. It is advantageous to provide the chains with "pushers" 10 at a given spacing, which project upwards from the plane of the chain and which provide a positive force to push the logs into the barking drum.

It will be apparent to those skilled in the art that the present invention is not restricted to the embodiments described above and that it may instead be varied within the scope of the appended claims. For example, although not explicitly shown in the drawings, it is advantageous if the bottoms of feed cylinder and barking drum lie in the same horizontal plane at the point where they meet.

We claim:

1. Apparatus for feeding roundwood into a rotating debarking drum by means of a conveyor located in front of the feeding end of said debarking drum, said apparatus comprising a feed cylinder operating as a stationary extension to said debarking drum, said feed cylinder having a diameter equal to or slightly less than the free inner diameter of said debarking drum.

2. Apparatus according to claim 1, wherein said conveyor is disposed at the bottom of said feed cylinder and additional means for conveying the roundwood towards said debarking drum are installed at opposite sides of said feed cylinder.

3. Apparatus according to claim 1, wherein said feed cylinder has a cross-section which is either round or curvilinearly tapered on one side, and the bottoms of said feed cylinder and said debarking drum lie in a common horizontal plane at a point where they meet.

4. Apparatus according to claim 1, including a loading section and, between said loading section and said feed cylinder, a regulator gate for controlling the flow of the roundwood into said debarking drum.

5. Apparatus according to claim 2, including a loading section and, between said loading section and said feed cylinder, a regulator gate for controlling the flow of the timber into said debarking drum.

6. Apparatus according to claim 3, including a loading section and, between said loading section and said feed cylinder, a regulator gate for controlling the flow of the timber into said debarking drum.

7. Apparatus according to claim 1, wherein the longitudinal axes of said debarking drum and said feed cylinder subtend an angle in the horizontal plane which is within a range of 0°–8° and which is freely adjustable within said range.

8. Apparatus according to claim 2, wherein the longitudinal axes of said debarking drum and said feed cylinder subtend an angle in the horizontal plane which is within a range of 0°–8° and which is freely adjustable within said range.

9. Apparatus according to claim 3, wherein the longitudinal axes of said debarking drum and said feed cylinder subtend an angle in the horizontal plane which is within a range of 0°–8° and which is freely adjustable within said range.

* * * * *

US004774987B1

REEXAMINATION CERTIFICATE (3420th)

United States Patent [19] [11] B1 4,774,987

Sepling [45] Certificate Issued Jan. 20, 1998

[54] APPARATUS FOR FEEDING ROUNDWOOD INTO A ROTATING BARKING DRUM

[75] Inventor: Matti Sepling, Rajamaki, Finland

[73] Assignee: Andritz Patentverwaltungs-Gesellschaft m.b.H., Graz, Austria

Reexamination Requests:
No. 90/004,453, Nov. 14, 1996
No. 90/004,643, May 19, 1997

Reexamination Certificate for:
Patent No.: 4,774,987
Issued: Oct. 4, 1988
Appl. No.: 17,049
Filed: Feb. 20, 1987

[51] Int. Cl.[6] ..... B27L 1/04
[52] U.S. Cl. ..... 144/208.9; 144/250.17; 144/341; 198/624; 198/836.1
[58] Field of Search ..... 198/620, 624, 198/836.1; 144/208.1, 208.3, 208.4, 208.9, 242.1, 245.2, 250.17, 341

[56] References Cited

U.S. PATENT DOCUMENTS

| | | | |
|---|---|---|---|
| 1,254,362 | 1/1918 | Schaanning . | |
| 1,300,730 | 4/1919 | Hutchins . | |
| 2,774,397 | 12/1956 | Leffler | 144/247 |
| 2,815,776 | 12/1957 | Annis, Jr. et al. | 144/208.9 |
| 2,891,589 | 6/1959 | Leffler | 144/247 |
| 2,916,064 | 12/1959 | Gaitten | 144/247 |
| 2,934,112 | 4/1960 | Valo | 144/208.4 |
| 3,019,825 | 2/1962 | Herolf | 144/208.8 |
| 3,807,470 | 4/1974 | Young | 144/208.9 |
| 3,973,606 | 8/1976 | Carbonneau | 144/208.9 |
| 4,180,109 | 12/1979 | Heikkinen | 144/208 |
| 4,362,195 | 12/1982 | Hill | 144/242.1 |
| 4,369,823 | 1/1983 | Gustafsson | 144/340 |
| 4,374,533 | 2/1983 | Svensson | 144/208.9 |
| 4,432,403 | 2/1984 | Heikkinen | 144/342 |
| 4,445,558 | 5/1984 | Banner et al. | 144/341 |
| 4,582,106 | 4/1986 | Huhta et al. | 144/208 |
| 4,640,327 | 2/1987 | Krilov | 144/340 |
| 5,044,412 | 9/1991 | Price et al. | 144/208.9 |

FOREIGN PATENT DOCUMENTS

| | | |
|---|---|---|
| 80464 | 5/1934 | Sweden . |
| 92338 | 5/1938 | Sweden . |
| 141060 | 6/1953 | Sweden . |
| 804436 | 2/1981 | U.S.S.R. . |
| 941183 | 7/1982 | U.S.S.R. . |
| 1219352 | 3/1986 | U.S.S.R. . |
| 1219353 | 3/1986 | U.S.S.R. . |

OTHER PUBLICATIONS

A.P.C. Application of A. Holzhey et al., Serial No. 354,762, Published May 11, 1943.
Invention Specification to an Author's Certificate, Abilevsky et al., Jul. 7, 1982.
Reports from Skärblacka and Norrsundet, pp. 26–30, Energi I Utveckling, Apr. 1986 (Translation attached).
V.J. Jelinek, *Tree–length woodyards gaining popularity in most of Canada*, Pulp & Paper Canada 86:10 (1985).

*Primary Examiner*—W. Donald Bray

[57] ABSTRACT

An apparatus for feeding roundwood into a rotating debarking drum through the inlet end of the barking drum utilizing a conveyor. The prior method presents the drawback that it is not possible, with a single feed device, to feed into the barking drum roundwood of different lengths but only either long, intermediate-sized or short logs. With the present invention, this problem has been solved in that the logs are positively fed by the conveyor, at low speed, into the lower part of the barking drum, through a feed cylinder.

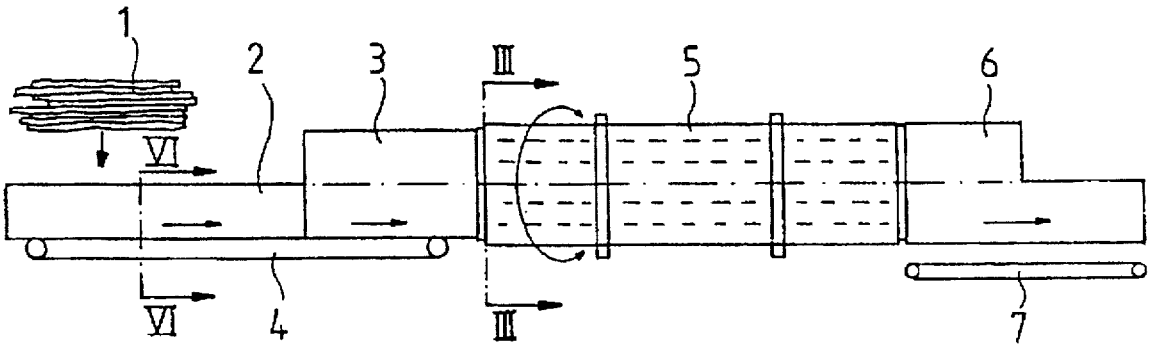

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–9 is confirmed.

New claims 10–15 are added and determined to be patentable.

*10. Apparatus according to claim 1, wherein said feed cylinder has a cross-section comprising non-symmetrical segments.*

*11. Apparatus according to claim 1, wherein said feed cylinder has a cross-section comprising segments which form an angle therebetween.*

*12. Apparatus according to claim 1, wherein said feed cylinder has a cross-section comprising circular segments.*

*13. Apparatus according to claim 1, wherein said apparatus includes a trough-like loading section located in front of said feed cylinder for receiving roundwood in bundles, said trough-like loading section having a conveying means for feeding said roundwood in bundles into said feed cylinder.*

*14. Apparatus according to claim 13, wherein said feed cylinder has a cross-section comprising segments which form an angle therebetween.*

*15. Apparatus according to claim 13, wherein said feed cylinder has a cross-section comprising circular segments.*

* * * * *